US010538362B2

(12) United States Patent
Sampaio

(10) Patent No.: US 10,538,362 B2
(45) **Date of Patent: *Jan. 21, 2020**

(54) BASKET TOTE WITH CADDY AND REMOVABLE MINI CADDY

(71) Applicant: Casabella Holdings L.L.C., Congers, NY (US)

(72) Inventor: Andre Sampaio, Valley Cottage, NY (US)

(73) Assignee: Bradshaw International, Inc., Rancho Cucamonga, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/820,958

(22) Filed: Nov. 22, 2017

(65) Prior Publication Data

US 2019/0152647 A1 May 23, 2019

(51) Int. Cl.

| | |
|---|---|
| ***B65D 21/02*** | (2006.01) |
| ***B65D 25/28*** | (2006.01) |
| ***B65D 25/24*** | (2006.01) |
| ***B65D 81/26*** | (2006.01) |
| ***B65D 1/24*** | (2006.01) |
| *A47K 1/00* | (2006.01) |

(52) U.S. Cl.

CPC ..... *B65D 21/0233* (2013.01); *B65D 1/24* (2013.01); *B65D 25/24* (2013.01); *B65D 25/2891* (2013.01); *B65D 81/261* (2013.01); *B65D 81/263* (2013.01); *A47K 1/00* (2013.01)

(58) Field of Classification Search

CPC .... B65D 21/0233; B65D 21/00; B65D 21/02; B65D 21/0235

USPC ..... 220/495.08

See application file for complete search history.

(56) References Cited

U.S. PATENT DOCUMENTS

| | | | | |
|---|---|---|---|---|
| 768,364 | A * | 8/1904 | Hines | B65D 21/0204 211/66 |
| 4,895,256 | A * | 1/1990 | Johnston | B25H 3/021 206/203 |
| 8,066,144 | B2 * | 11/2011 | McNamara | B65F 1/06 220/495.01 |
| 8,636,169 | B2 | 1/2014 | Sampaio | |

* cited by examiner

*Primary Examiner* — Andrew T Kirsch
*Assistant Examiner* — Don M Anderson
(74) *Attorney, Agent, or Firm* — Mintz, Levin, Cohn, Ferris, Glovsky and Popeo, P.C.

(57) ABSTRACT

A basket tote having both a caddy and a removable mini caddy is disclosed. The removable mini caddy attaches to the caddy with a series of guide walls and guide wall retainers that allow the removable mini caddy to be cooperatively received by the caddy. The handle of the removable mini caddy nests with the handle of the caddy while they are attached, providing the user with a single handled basket tote that is easy to transport and use while still having the convenience of an extra tote where objects can be temporarily removed and then replaced without the need for transferring the objects from one tote to another. The removable mini caddy may be easily removed and then replaced within the caddy while remaining securely in place during use and transport.

21 Claims, 18 Drawing Sheets

BASKET TOTE WITH CADDY AND REMOVABLE MINI CADDY

BACKGROUND OF THE INVENTION

1. Field of the Invention

This invention relates generally to totes, and more specifically to a basket tote having a caddy and a removable mini caddy.

2. Description of Related Art

A tote refers to any device that can be carried by hand for holding, retaining and transporting objects. While tote may refer to the act of carrying or transporting something, a tote may also refer to a device used to carry or transport things. Tote bags are a type of tote, as are tote baskets, tote buckets, tote boxes, tote carts, tote handbags, laundry totes, and the like. Totes in general have been around for thousands of years and have been made from woven reeds, bamboo, wood, bark, sticks, grass, animal hide, animal hair and quills, and other natural materials. Totes have also been made from metals such as copper or iron wire, strips, foil, sheet, and the like. Many modern totes are fabricated from plastic. Most totes have a handle or handles to make the job of carrying a loaded tote that much easier. Totes also are made in various sizes for different applications, and may contain a variety of compartments again depending on the intended application. Other features such as retainers, clips, holes, and the like may also be present on some totes to keep the objects within the tote neat and organized, and to prevent shifting of those objects while transporting the tote.

Oftentimes one will use multiple totes to retain different objects, and to allow one set of objects to be moved independently of the other. This eliminates the problem of transferring some of the needed objects to another location while retaining other objects within the tote, and then replacing those needed objects once they are brought back to the original location. While this may make the job of moving some of the objects easier, it also represents a challenge if a user only has one free hand to work with because the other is already being used to carry something else. What is needed is a way to carry multiple totes with a single hand. What is also needed is a way to temporarily remove some objects from a tote, transport them easily to another location, and then easily return them back to the tote.

A caddy is typically a small storage container, often with divisions, compartments, walls, or other partitions to keep items separated and organized. A caddy can have a feature such as a handle for ease of transport, and as such, may be considered a tote of sorts. As such, it is one object of the present invention to provide a tote having a caddy and a removable mini caddy.

These and other objects of the present invention are not to be considered comprehensive or exhaustive, but rather, exemplary of objects that may be ascertained after is reading this specification with the accompanying drawings and claims.

BRIEF SUMMARY OF THE INVENTION

In accordance with the present invention, there is provided a basket tote comprising a caddy and a removable mini caddy. The caddy comprises a handle with a concave upper surface, at least one compartment, a rim, a retaining tab extending outward from the rim, and a handle stop connected to a lower portion of the handle. The removable mini caddy comprises a handle having a generally convex underside for receiving the concave upper surface of the handle of the caddy in a nested configuration, a handle guide connected to a lower portion of the handle and continuing with the convex underside of the handle, at least one compartment, a guide wall retainer located along an outer periphery of the removable mini caddy, and a corner stop located at a corner of the removable mini caddy.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
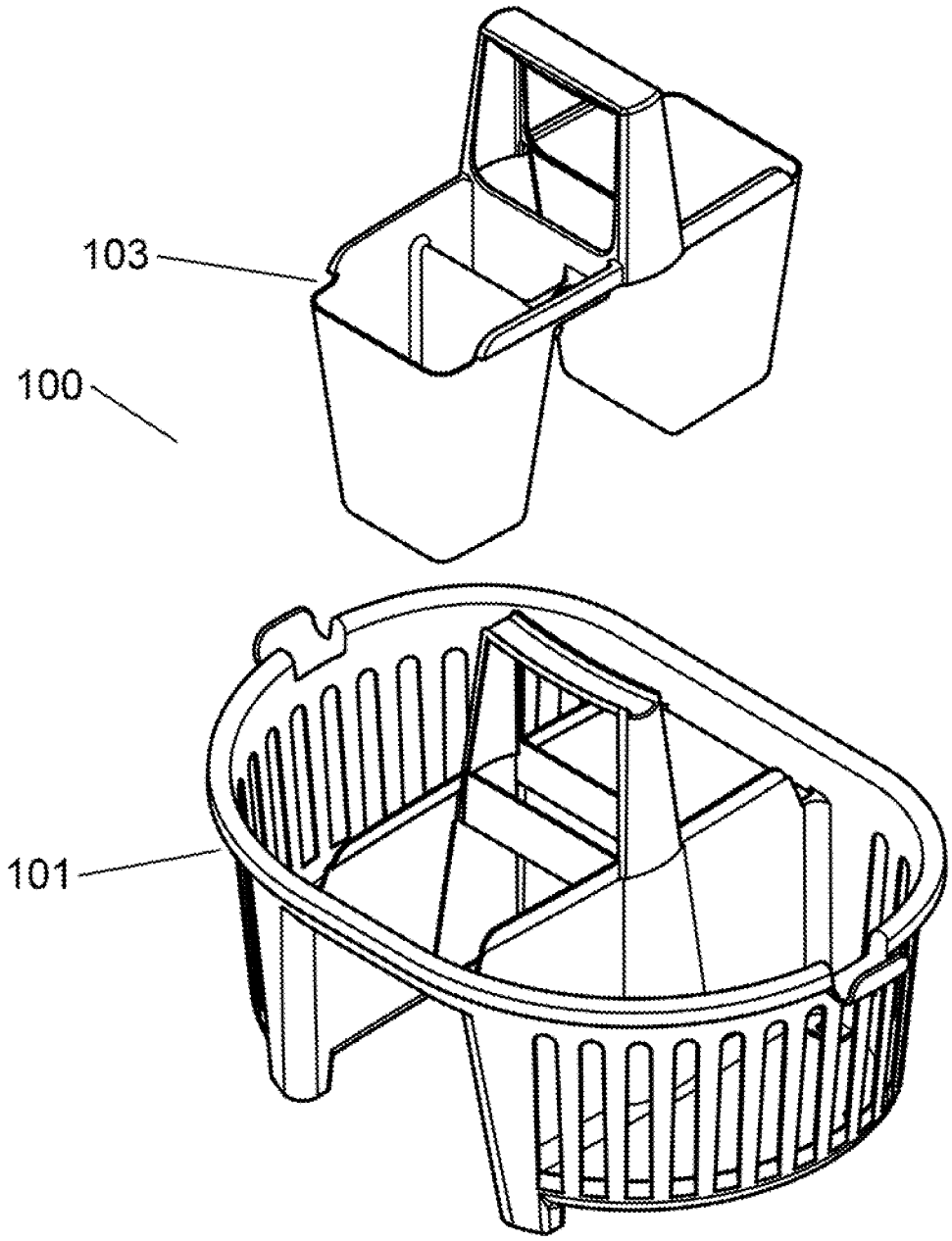
FIG. 1 is a perspective view of the basket tote with the caddy and removable mini caddy separated.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification, claims and the attached drawings.

DESCRIPTION OF THE PREFERRED EMBODIMENTS

For a general understanding of the present invention, reference is made to the drawings. In the drawings, like reference numerals have been used throughout to designate identical elements.

The term tote, as used herein, refers to the collective assembly of both a caddy and a removable mini caddy. A basket tote refers to the basket like appearance and functional shape of the tote. The attached drawings depict the tote as such an assembly with the caddy and removable mini caddy nested together, as well as the caddy alone and also the removable mini caddy alone. The caddy and the removable mini caddy and the way in which the two cooperatively interconnect to form the tote will be further described in this specification. To begin, FIG. 1 is a perspective view of the tote with the removable mini caddy separated from the caddy. The tote 100 comprises a caddy 101 and a removable mini caddy 103. The removable mini caddy 103 attaches to the caddy with a series of retainers, guide walls and nested handles that allow the removable mini caddy to be placed within, and be connected to, the caddy 101. The handle of the removable mini caddy 103 nests with the handle of the caddy while they are attached, providing the user with a single handled tote that is easy to transport and use while still having the convenience of an extra tote where objects can be temporarily removed and then replaced without the need for transferring the objects from one tote to another. The handle of the caddy has a concave upper surface to receive the convex lower surface or underside of the handle of the removable mini caddy. The removable mini caddy 103 may be easily removed and then replaced within the caddy 101 while remaining securely in place during use and transport. The novel aspects of the structure of the caddy 101 and the removable mini caddy 103 will be further described by way of the remaining figures and this specification.

Figure 2:
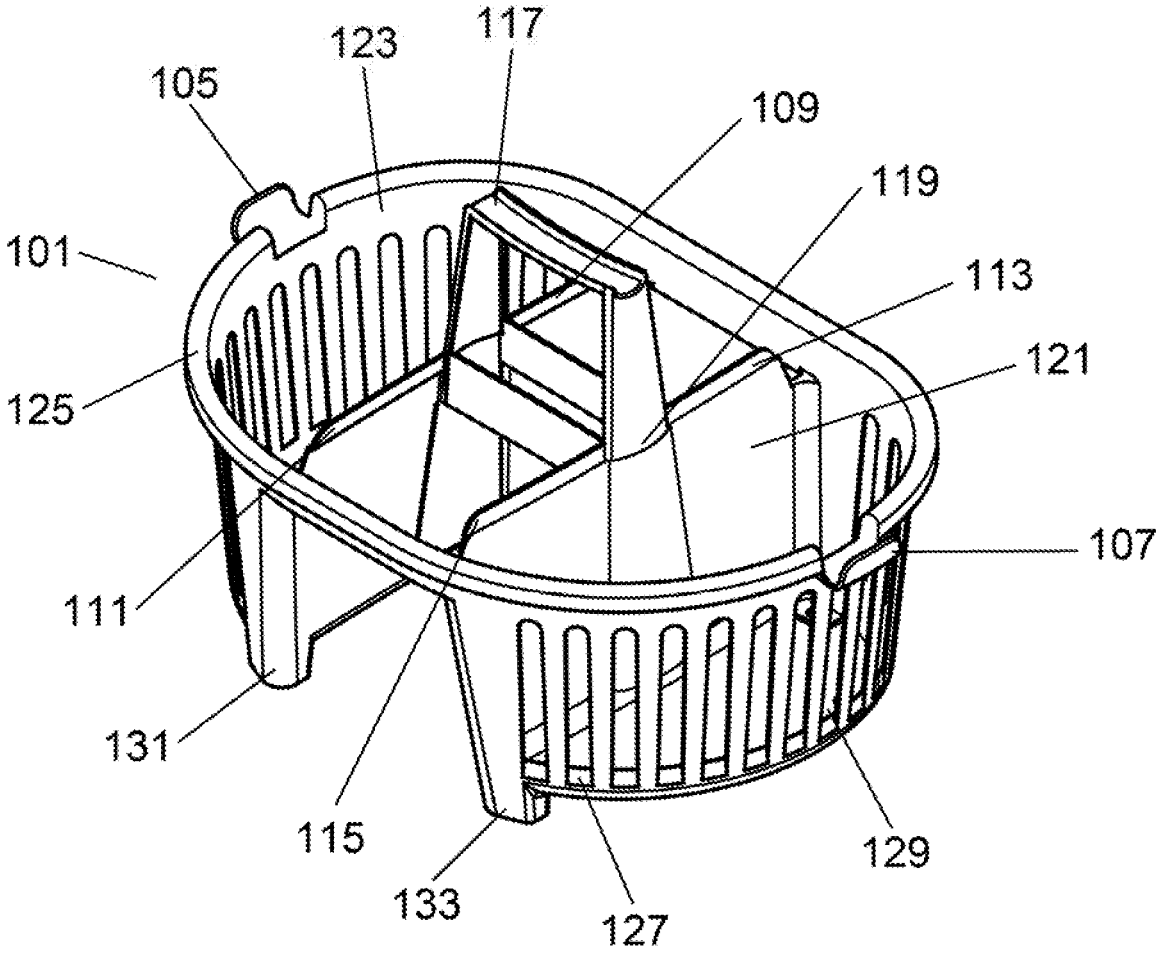
FIG. 2 is a perspective view of the caddy.

FIGS. 2-7 depict the caddy 101 without the removable mini caddy 103 for clarity of description. FIG. 2 is a perspective view of the caddy. The caddy has rounded ends that may, in some embodiments of the present invention, be asymmetrical. The overall shape of the caddy and thus the resulting tote is reminiscent of a basket of sorts. The caddy comprises a concave handle 117 that may, in some embodiments of the present invention, have features such as a generally concave upper surface for structural rigidity and also for assisting in the retention of the removable mini caddy 103 (not shown, see FIGS. 8-13). Connected to a lower portion of the handle is a first handle stop 119 that provides a ledge or similar raised feature to securely stop and retain the removable mini caddy 103 (see FIGS. 8-13). The caddy 101 further has at least one compartment. A first compartment 121, and in some embodiments of the present invention a second compartment 123 or additional compartments, may also be employed. The caddy 101 further has a rim 125 along the outer periphery of the caddy 101 for structural integrity and also to provide a smooth finish to the periphery of the caddy 101 and related compartments. The caddy 101 and its related compartments may also optionally have slots 127 along vertical walls such as the outer vertical walls of the caddy 101 to improve ventilation and also to reduce plastic cost in manufacturing. The caddy 101 may further optionally have drainage holes that may, in some embodiments of the present invention, be integrated with feet for the caddy. A first draining standoff 131 and a second draining standoff 133 can be seen in FIG. 2. Not seen in FIG. 2 are third and fourth draining standoffs. Each draining standoff comprises a foot or similar structure that has a drain hole there through. The drain hole goes through the bottom of each compartment and through the standoff or foot to provide draining of each compartment. A depressed area at the bottom of each compartment contains the drain hole and allows liquids to pass through the foot or standoff.

In addition to the structural features of the handle 117 that provide interoperability with a removable mini caddy (depicted in FIGS. 8-13), the caddy 101 has a first retaining tab 105 and a second retaining tab 107. Each retaining tab begins below the upper edge of the rim 125 and extends outward in a generally horizontal plane and then turns upward. In some embodiments of the present invention, the corners of the retaining tab are rounded or otherwise have a radius. The retaining tabs allow one to hang objects that may be wet or too large for the caddy itself. For example, loofa sponges, washcloths, flip flops, and the like. Further depicted in FIG. 2 are guide walls to facilitate placement of the removable mini caddy within the caddy. The guide walls not only provide structure to the caddy 101 in that they may be a continuation of a vertical wall of the caddy or a compartment within the caddy, but they also serve to further restrict movement of the removable mini caddy 103 (see FIGS. 8-13). The example of FIG. 2 depicts a first guide wall 109, a second guide wall 111, a third guide wall 113, and a fourth guide wall 115. As will be seen in later figures, the guide walls cooperatively couple to guide wall retainers on the removable mini caddy. Various materials may be used to make the caddy and the removable mini caddy. Examples of suitable plastic materials include, for example, low density polyethylene (LDPE), linear low density polyethylene (LLDPE), high density polyethylene (HDPE), polypropylene, and acrylonitrile butadiene styrene (ABS). The caddy and the removable mini caddy may be made by injection molding, blow molding, die cutting, or similar techniques used to fabricate plastic components. Other materials may include various plastics containing reinforcements such as fibers, particles, or the like.

Figure 3:
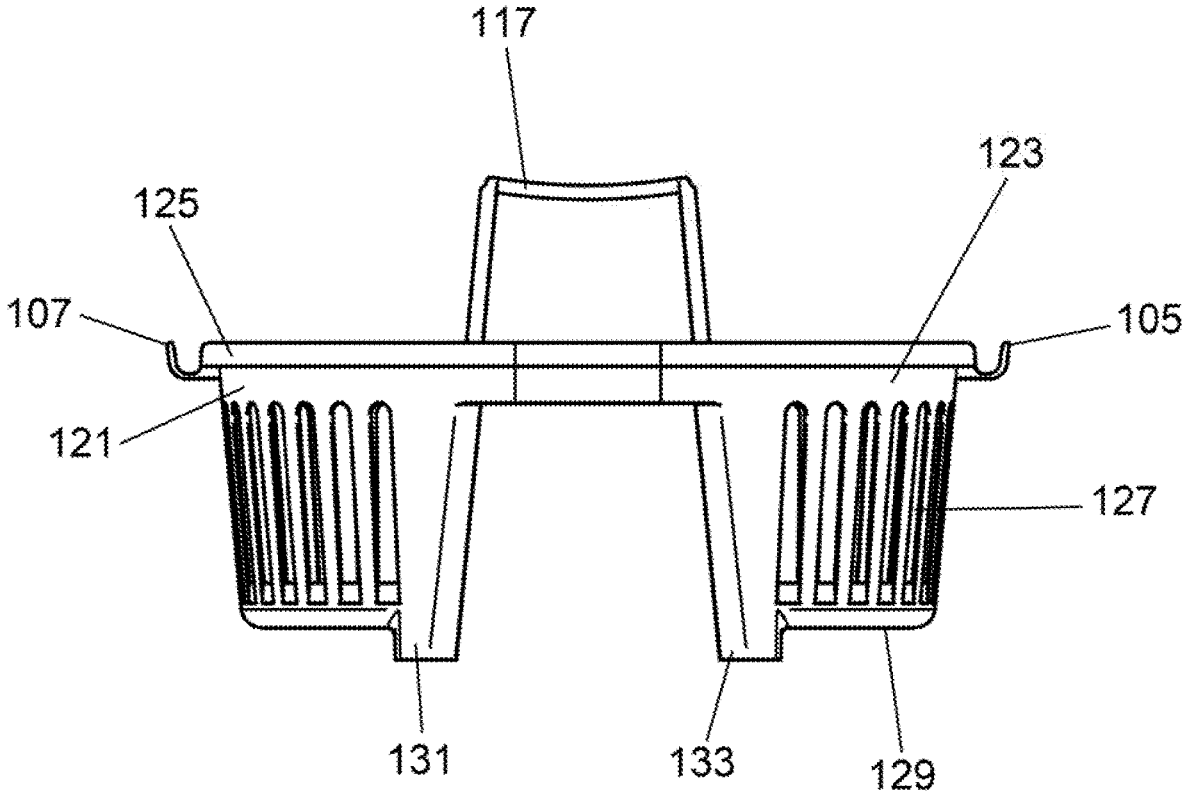
FIG. 3 is a side plan view of the caddy.
Figure 4:
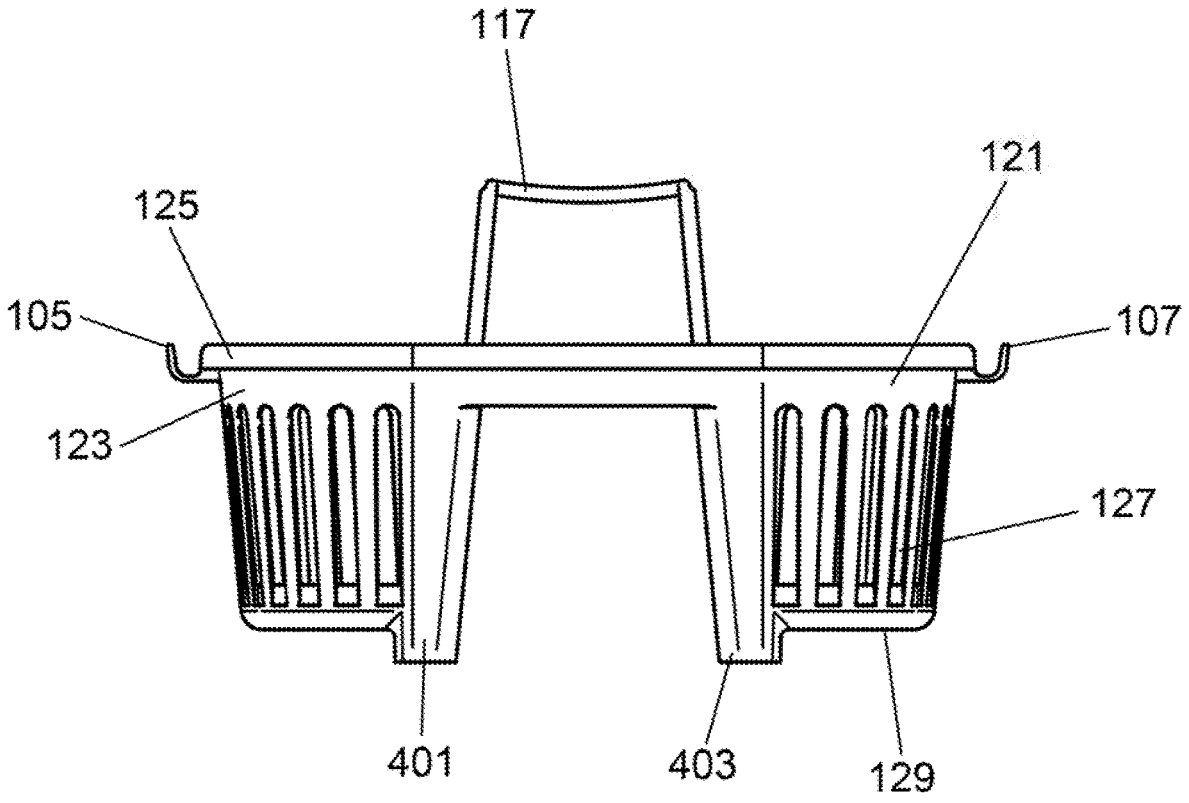
FIG. 4 is an opposite side plan view of the caddy.

FIG. 3 is a side plan view of the caddy and FIG. 4 is an opposite side plan view of the caddy. The drainage holes 129 may have a downwardly directed flange around their perimeter. Other embodiments of the present invention may omit or modify the downwardly directed flange. Also, as seen in FIGS. 3 and 4, the two sides depicted are of the same general appearance. Also seen in FIG. 4 is a third draining standoff 401 and a fourth draining standoff 403.

Figure 5:
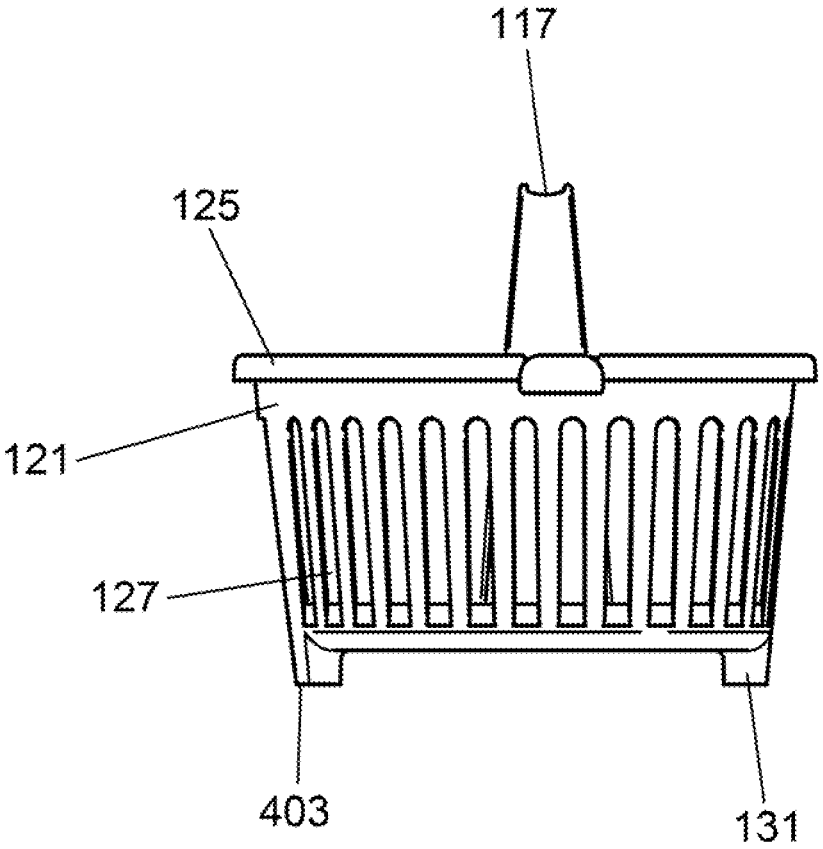
FIG. 5 is an end plan view of the caddy.
Figure 6:
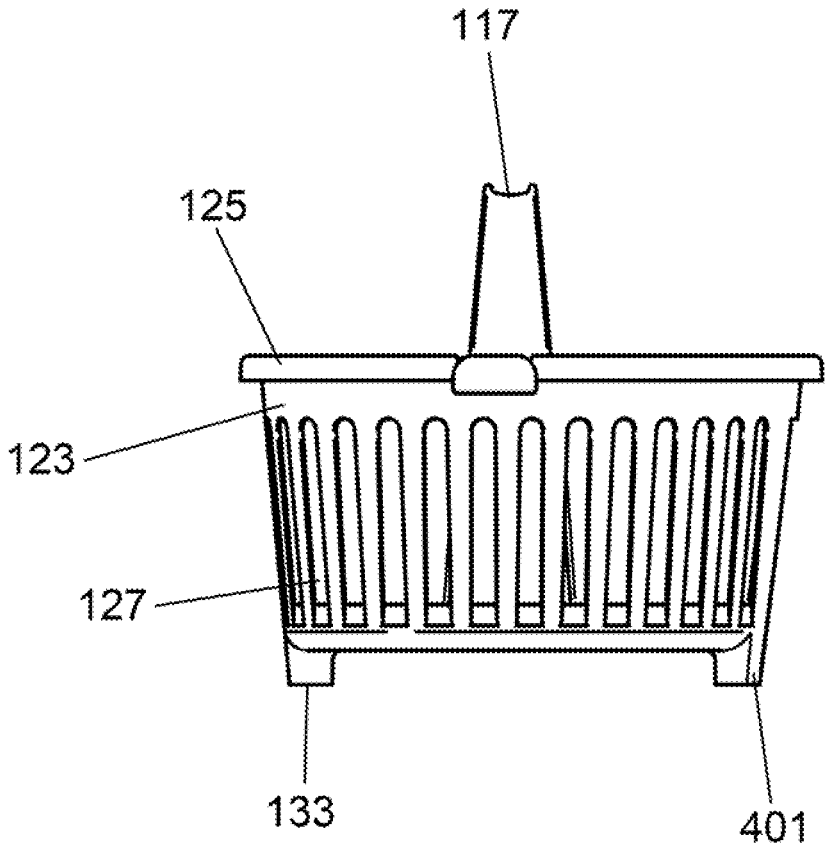
FIG. 6 is an opposite end plan view of the caddy.

Now turning to FIGS. 5 and 6, FIG. 5 is an end plan view of the caddy alone and FIG. 6 is an opposite end plan view of the caddy alone. The handle 117 can be seen with a generally concave upper surface for structural integrity and also to better accommodate the handle of the removable mini caddy (see FIGS. 8-13). Various handle geometries may be employed without departing from the spirit and broad scope of the present invention. As can be seen by way of FIGS. 5 and 6, the two ends of the caddy are of the same general appearance.

Figure 7:
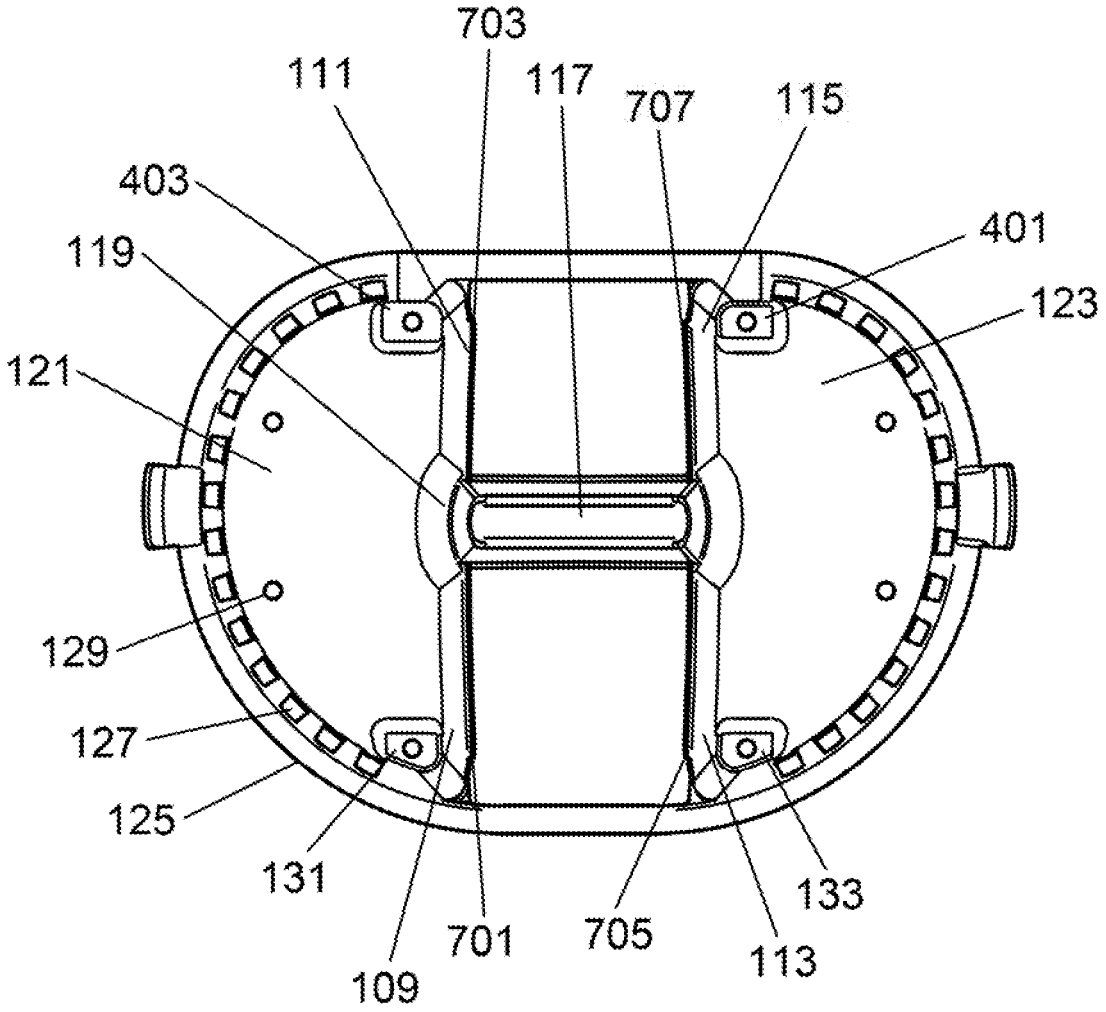
FIG. 7 is a top plan view of the caddy.

FIG. 7 is a top plan view of the caddy alone. In this view, a plurality of drainage holes 129 can be seen. Various embodiments may employ different numbers of drainage holes or no drainage holes whatsoever. In the plan view of FIG. 7, guide walls 109, 111, 113, and 115 can be seen. A radius corner for each guide wall mates with the retainers of the mini caddy. Thus, a first radius corner 701, a second radius corner 703, a third radius corner 705 and a fourth radius corner can be seen. A first radius corner 701, a second radius corner 703, a third radius corner 705 and a fourth radius corner 707 can also be seen. Each radius corner may be molded from plastic in one piece along with the caddy, and provide a smooth and tapered edge to ease the mini caddy into the caddy when nested together.

Figure 8:
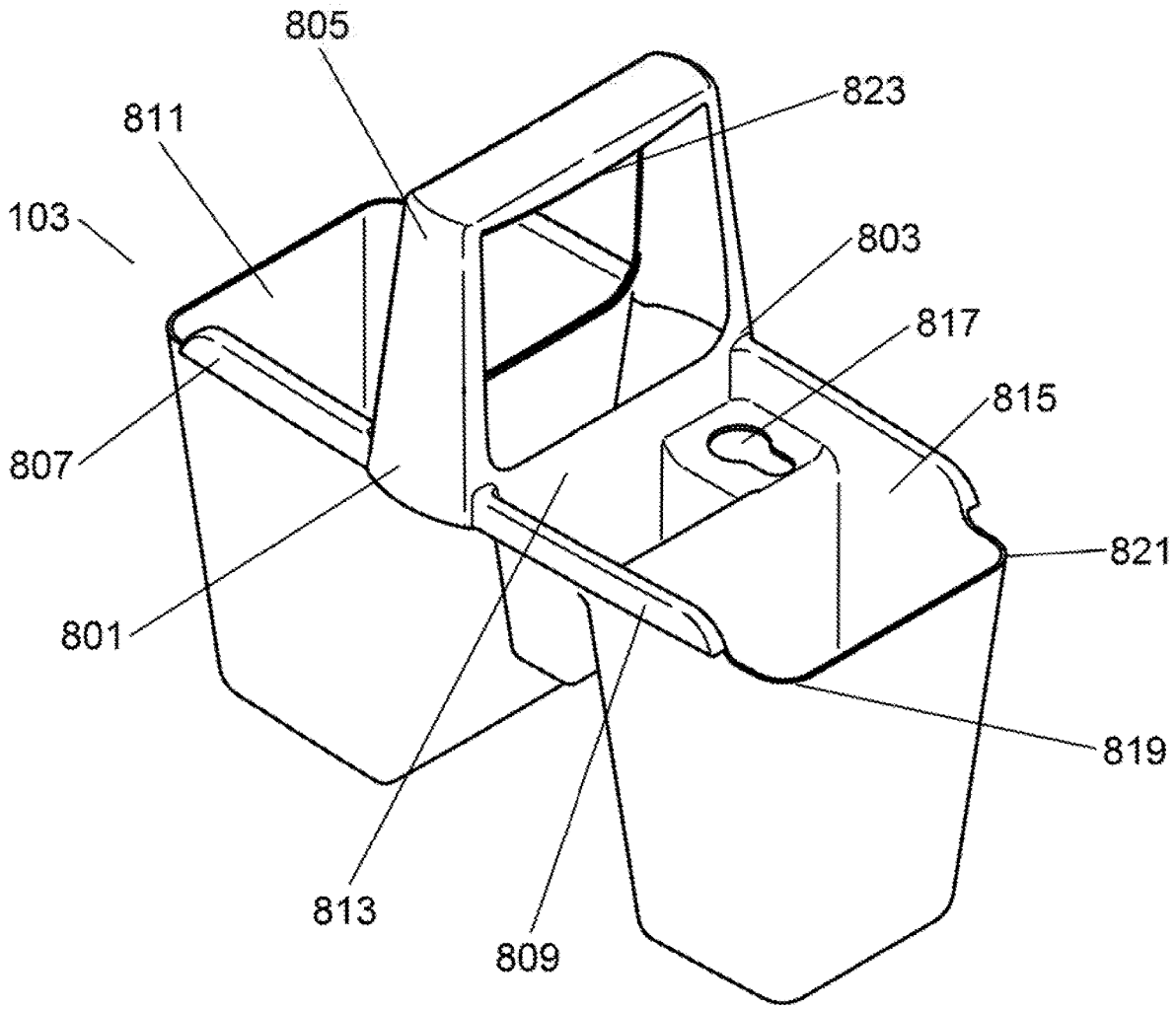
FIG. 8 is a perspective view of the removable mini caddy.
Figure 10:
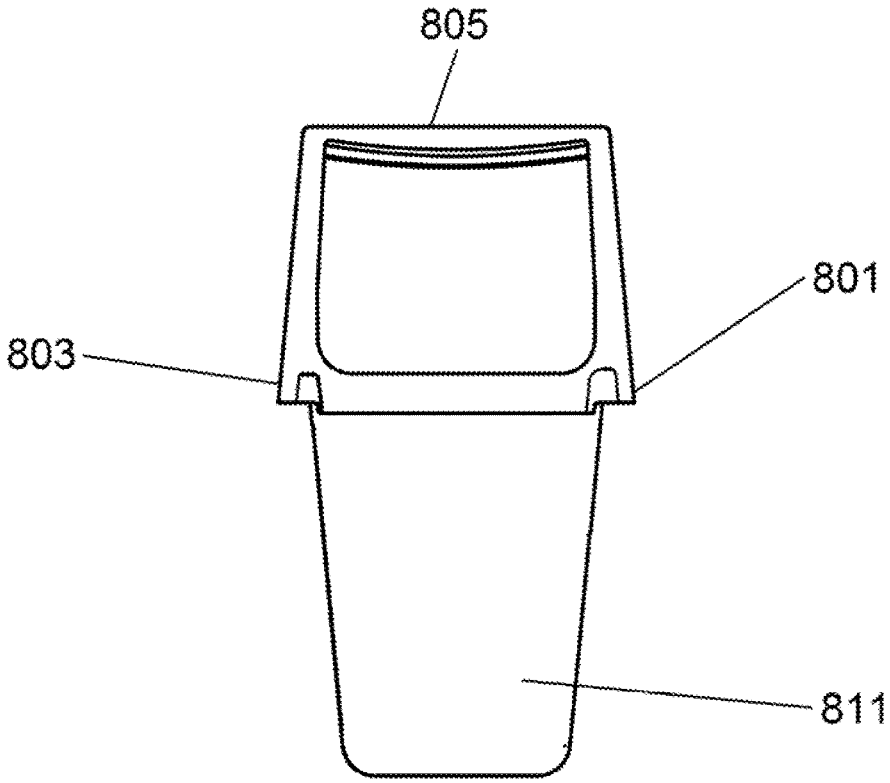
FIG. 10 is an opposite side plan view of the removable mini caddy.
Figure 11:
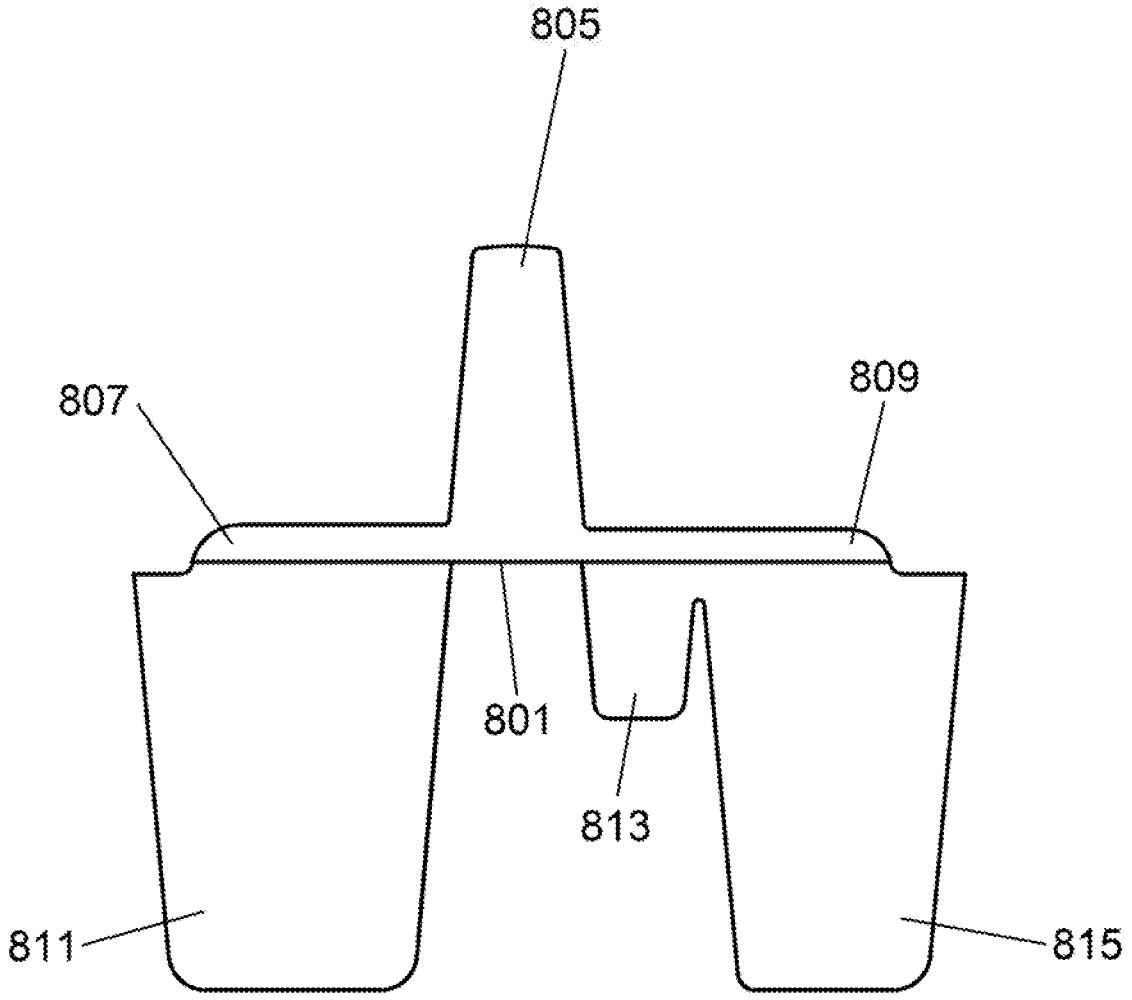
FIG. 11 is an end plan view of the removable mini caddy.
Figure 12:
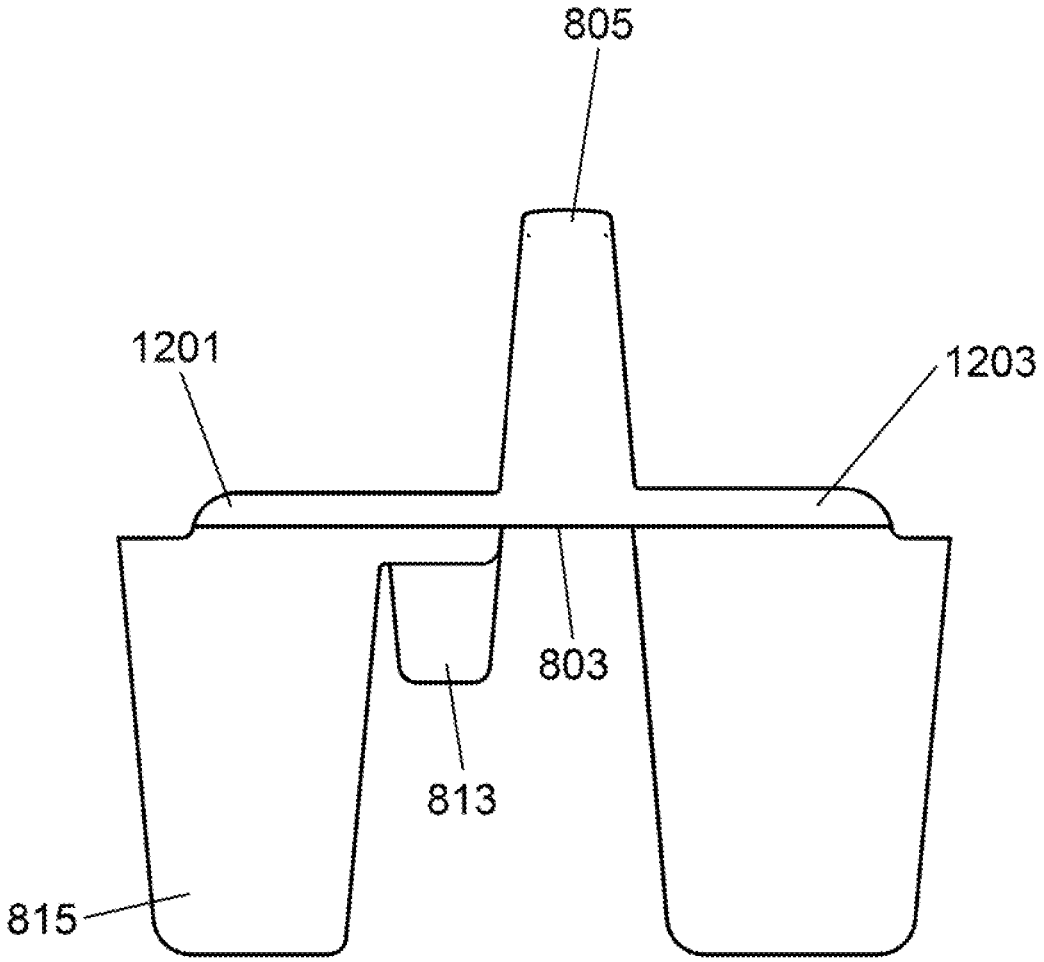
FIG. 12 is an opposite end plan view of the removable mini caddy.

FIGS. 8-13 depict various views of the removable mini caddy 103. FIG. 8 is a perspective view of the removable mini caddy 103. A handle 805 is depicted. The handle 805 has a generally convex underside for receiving the handle of the caddy in a nested configuration. In some embodiments of the present invention, the handle 805 may have under handle ridges 823 within the generally convex underside. A first handle guide 801 and a second handle guide 803 may be seen in FIG. 8. These handle guides are extensions of the handle 805 and can be considered connected to a lower portion of the handle 805. The handle guides each have a concave underside that is an extension and continuation of the convex underside of the handle 805. The first handle guide 801 and the second handle guide 803 serve to receive the handle of the caddy when the removable mini caddy is placed upon the caddy. As previously depicted in FIG. 2 and FIG. 7, the first handle stop 119 and the second handle stop 709 of the caddy serve to halt the downward movement of the removable mini caddy by contacting the ends of the handle stops of the removable mini caddy. A first guide wall retainer 807 and a second guide wall retainer 809 can be seen in FIG. 8. FIG. 12 depicts a third guide wall retainer 1201 and a fourth guide wall retainer 1203. The guide wall retainers are formed of plastic and provide a downward projecting edge or lip that captures and retains a guide wall of the caddy (see FIG. 2, reference numbers 109, 111, 113, and 115). The guide wall retainers are closed on one end, and the closed end of each guide wall retainer is curved to conform to and guide the radius corners of the caddy 101. On each of the two end sides of the removable mini caddy, a first corner stop 819 and a second corner stop 821 can be seen. The first corner stop 819 and the second corner stop 821 are each located at a corner of the mini caddy and have a generally flared or L shaped configuration to mate with a similar geometry on the caddy. The first corner stop 819 and the second corner stop 821 have a width sufficient to span across a guide wall of the caddy. The removable mini caddy 103 also has various storage areas and features such as, for example, a first storage area 811, a second storage area 813, and a third storage area 815. Various embodiments of the present invention may have differing numbers, sizes and configurations of storage areas. An example of a storage feature is the toothbrush holder 817, which comprises an opening as well as a retainer clip of structure. Various materials may be used to make the caddy and the removable mini caddy. Examples of suitable plastic materials include, for example, low density polyethylene (LDPE), linear low density polyethylene (LLDPE), high density polyethylene (HDPE), polypropylene, and acrylonitrile butadiene styrene (ABS). The caddy and the removable mini caddy may be made by injection molding, blow molding, die cutting, or similar techniques used to fabricate plastic components. Other materials may include various plastics containing reinforcements such as fibers, particles, or the like.

Figure 9:
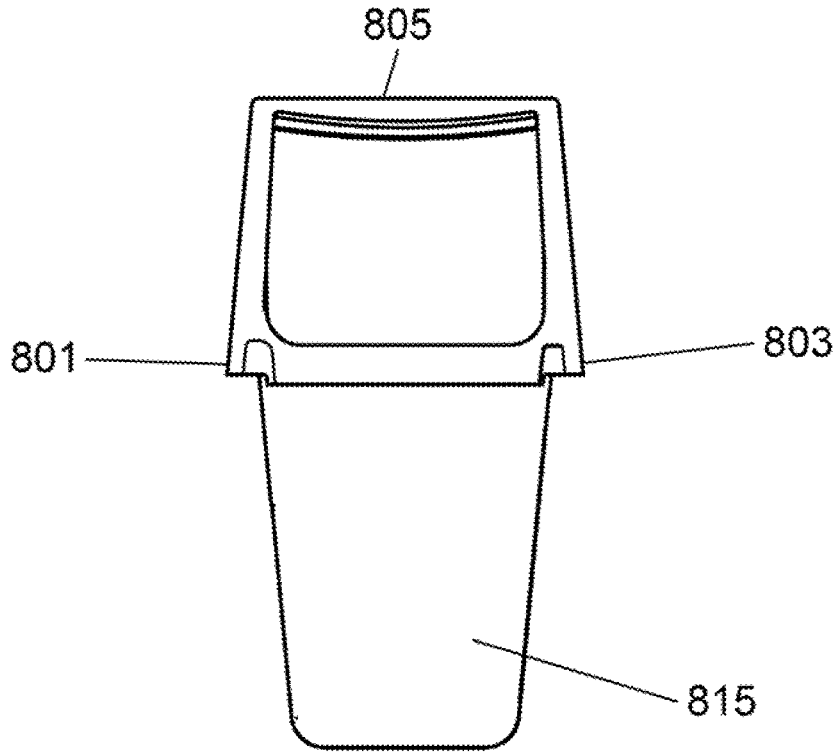
FIG. 9 is a side plan view of the removable mini caddy.
Figure 13:
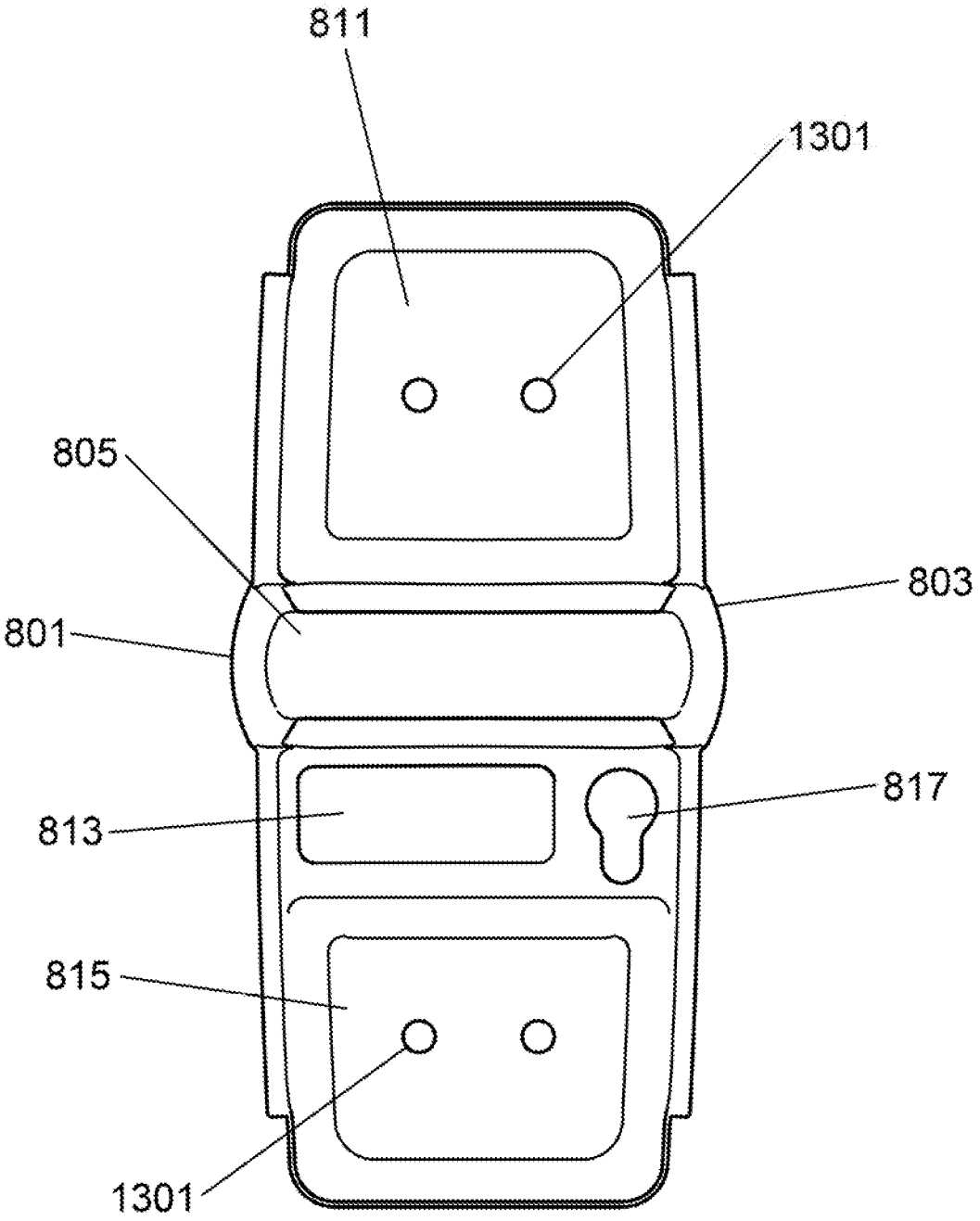
FIG. 13 is a top plan view of the removable mini caddy.

FIG. 9 is a side plan view of the removable mini caddy clearly depicting the first handle guide 801 and the second handle guide 803. FIG. 10 is an opposite side plan view of the removable mini caddy that is generally of the same appearance as FIG. 10. FIG. 11 is an end plan view of the removable mini caddy depicting the first guide wall retainer 807 and the second guide wall retainer 809. The various compartments can also be seen in outline form. Different compartment sizes, configurations and geometries may also be employed in some embodiments of the present invention. FIG. 12 is an opposite end plan view of the removable mini caddy depicting the third guide wall retainer 1201 and the fourth guide wall retainer 1203. To complete the views of the removable mini caddy 103, FIG. 13 is a top plan view of the removable mini caddy. Drain holes 1301 can be seen. Some embodiments of the present invention may have different quantities or placement of drain holes, or may have no drain holes whatsoever.

Figure 14:
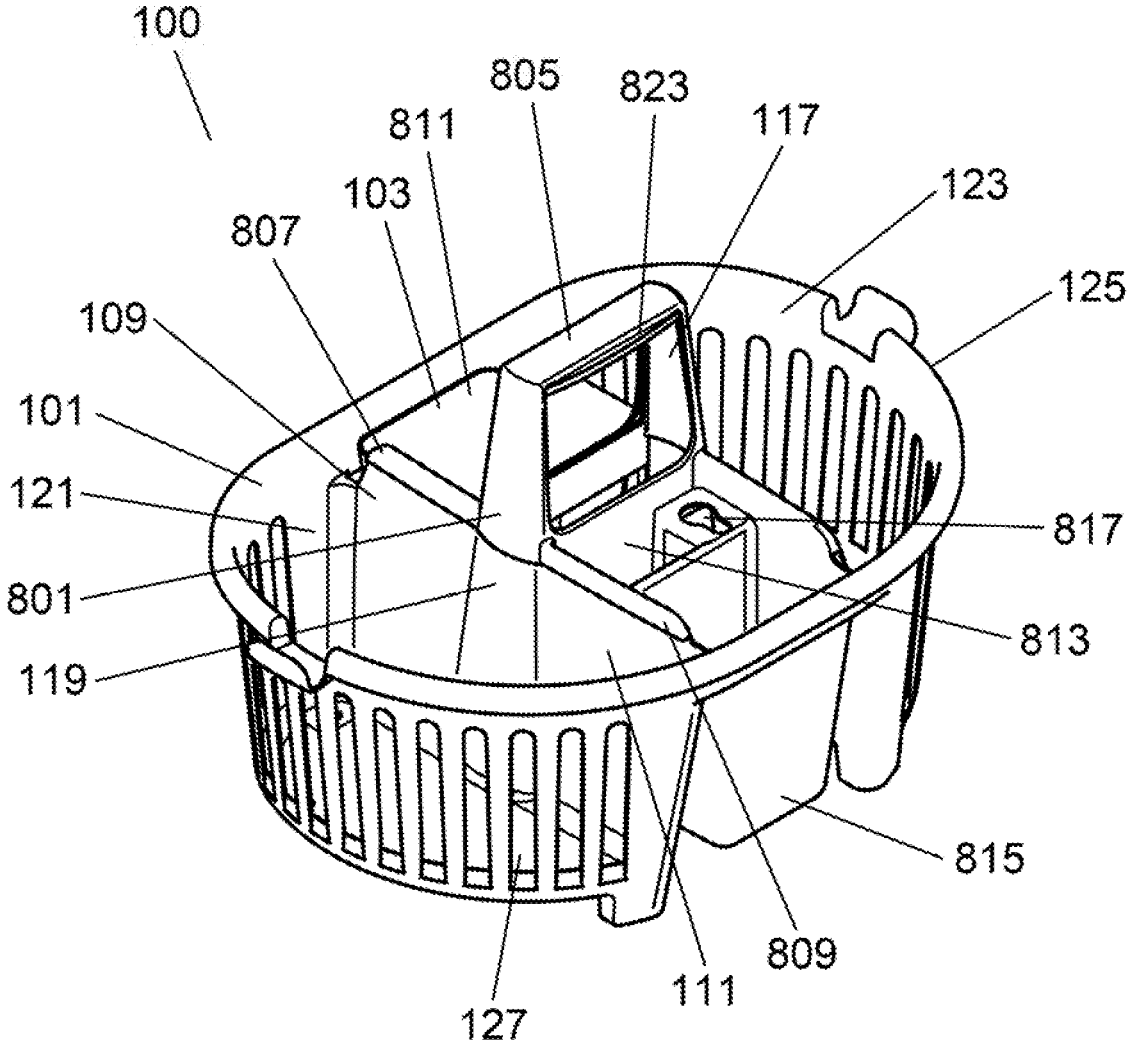
FIG. 14 is a perspective view of the basket tote with the caddy and removable mini caddy nested together.
Figure 15:
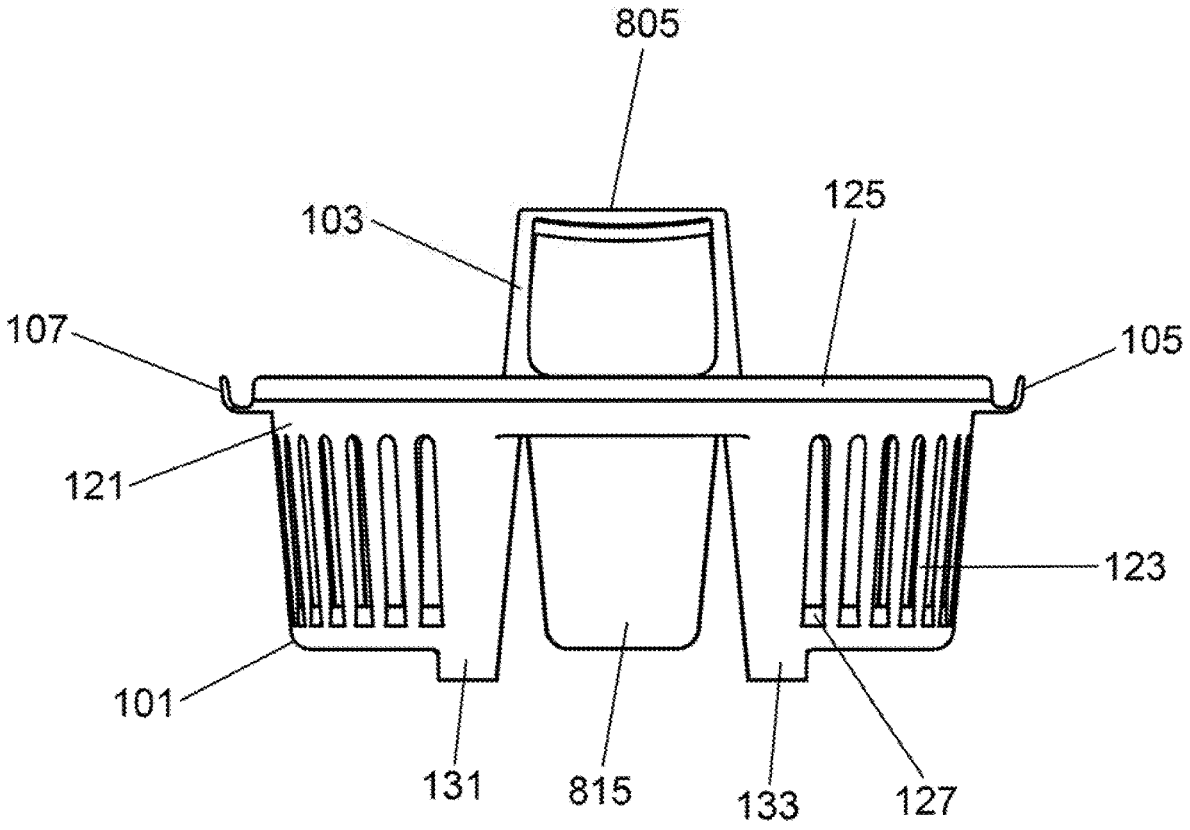
FIG. 15 is a side plan view of the basket tote with the caddy and removable mini caddy nested together.
Figure 16:
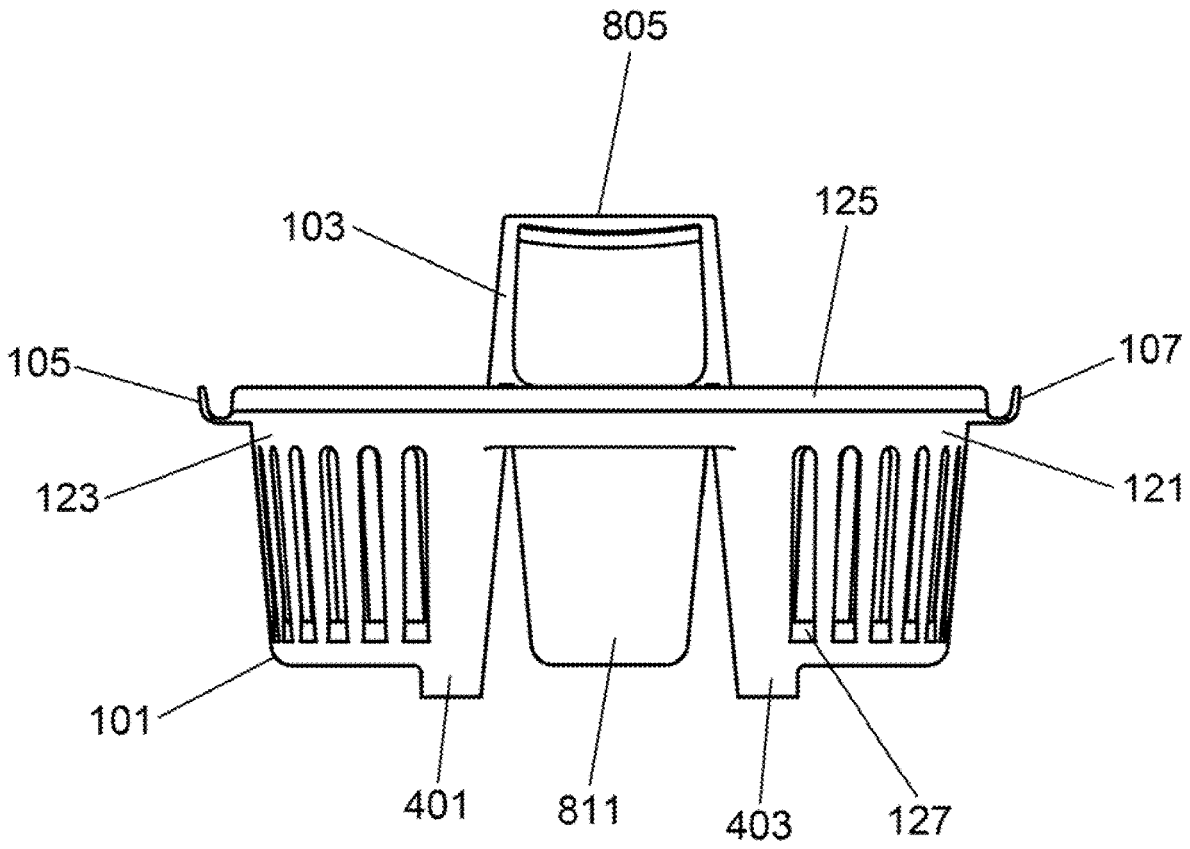
FIG. 16 is an opposite side plan view of the basket tote with the caddy and removable mini caddy nested together.
Figure 17:
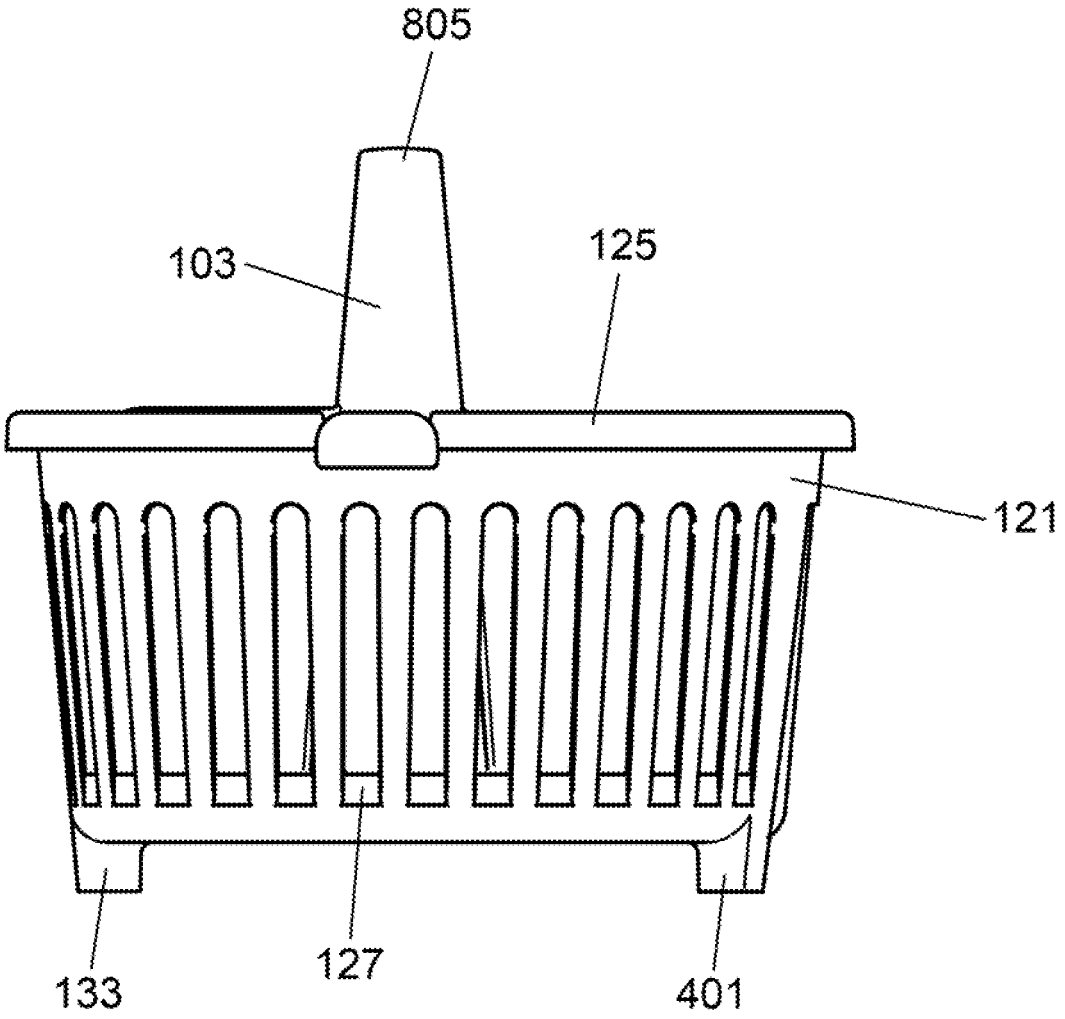
FIG. 17 is an end plan view of the basket tote with the caddy and removable mini caddy nested together.
Figure 18:
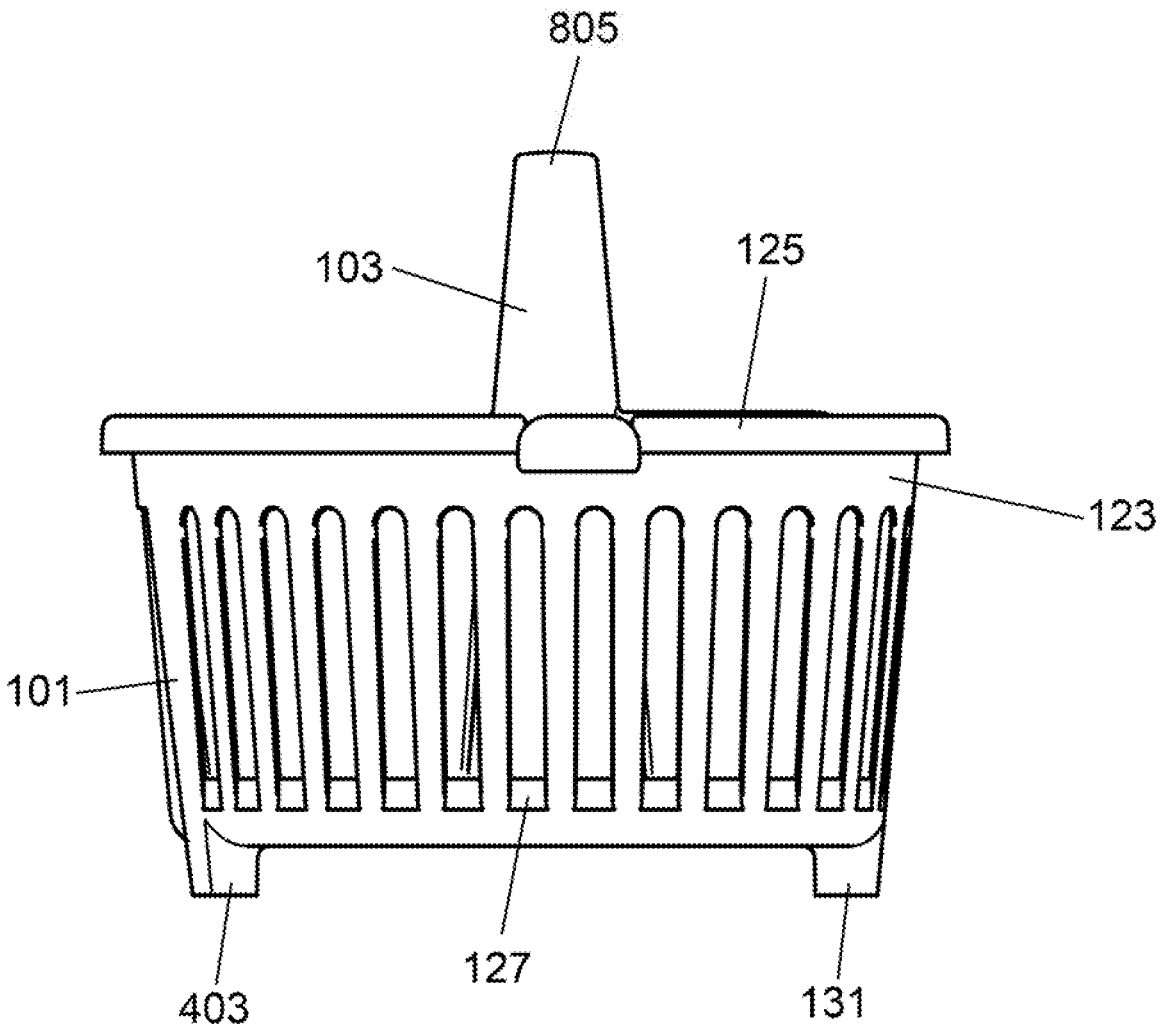
FIG. 18 is an opposite end plan view of the basket tote with the caddy and removable mini caddy nested together.
Figure 19:
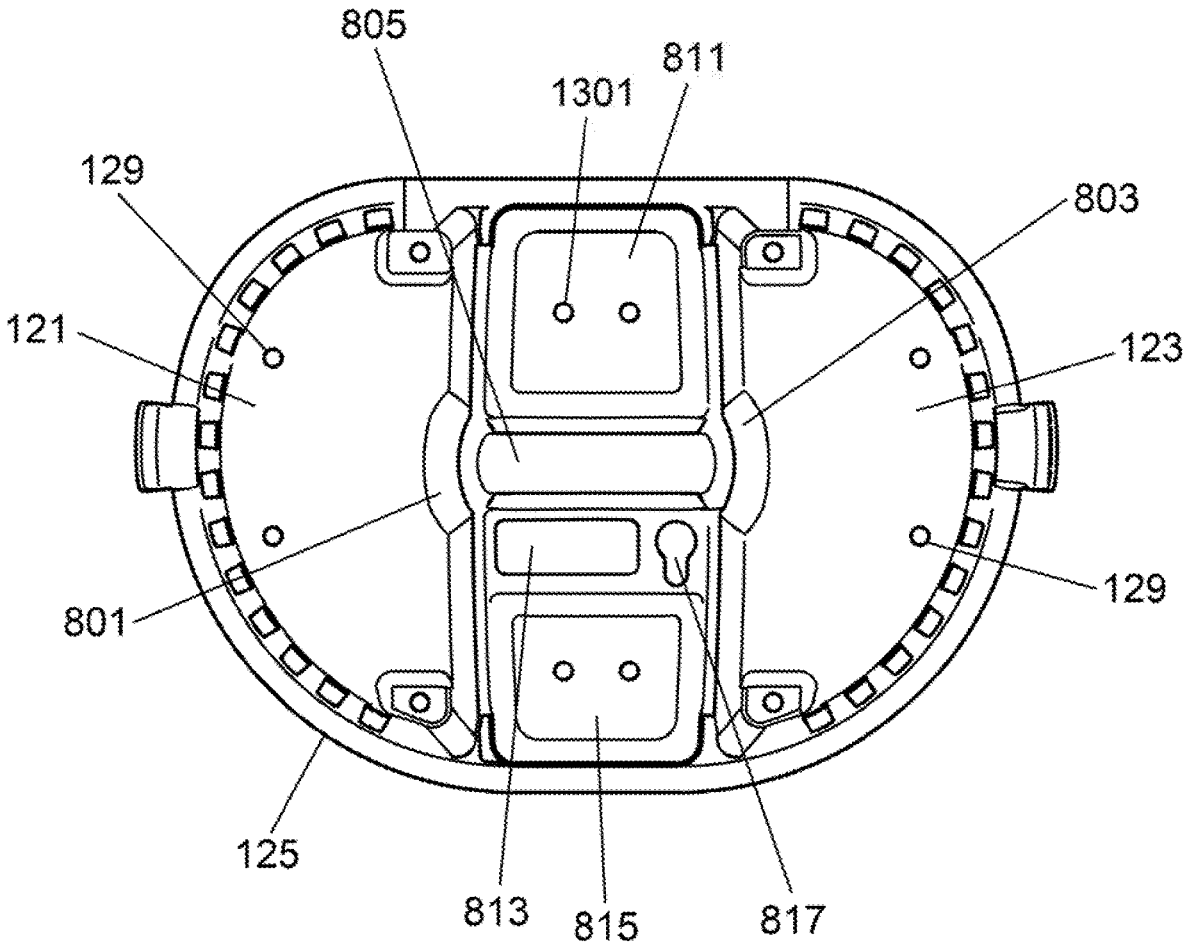
FIG. 19 is a top plan view of the basket tote with the caddy and removable mini caddy nested together.

The removable mini caddy 103 is placed upon and within the caddy 101 to form a tote 100. FIGS. 14-19 depict such an arrangement. To use the tote 100, one may either place the removable mini caddy 103 upon the caddy 101, or remove the removable mini caddy 103 from the caddy 101, as clearly depicted in FIG. 1. Materials and objects are placed within the caddy and the removable mini caddy, and removed therefrom. The tote 100 may be transported by way of the nested handles of both the caddy 101 and the removable mini caddy 103, or the caddy 101 and the removable mini caddy 103 may be used separately and transported by their respective handles. FIG. 14 is a perspective view of the tote with the removable mini caddy in place. The handle 117 of the caddy can be seen nested within the generally convex underside of the handle 805 of the removable mini caddy 103. In addition, a storage area of the removable mini caddy 103, in this example a third storage area 815, can be seen protruding through the caddy 101. FIG. 15 is a side plan view of the tote with the removable mini caddy in place on the caddy and FIG. 16 is an opposite side plan view of the tote with the removable mini caddy in place on the caddy. FIG. 17 is an end plan view of the tote with the removable mini caddy in place on the caddy and FIG. 18 is an opposite end plan view of the tote with the removable mini caddy in place on the caddy. Lastly, FIG. 19 is a top plan view of the tote with the removable mini caddy in place on the caddy.

It is, therefore, apparent that there has been provided, in accordance with the various objects of the present invention, a basket tote having a caddy and removable mini caddy. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. A tote comprising:

a caddy comprising a handle with a concave upper surface, a first compartment having a semi-circular portion and a second compartment having a semi-circular portion, the two semi-circular portions being joined with a linear portion to make up an oval shaped rim, a non-moveable retaining tab extending outward from the oval shaped rim in a generally horizontal plane and then having an upward turn, a first guide wall, and a handle stop connected to a lower portion of the handle; and a removable mini caddy comprising a handle having a generally convex underside for receiving the concave upper surface of the handle of the caddy in a nested configuration, a handle guide connected to a lower portion of the handle and continuing with the convex underside of the handle, at least one compartment, a first guide wall retainer located along an outer periphery of the removable mini caddy, and a corner stop located at a corner of the removable mini caddy.

2. The tote of claim 1, wherein the caddy further comprises a second non-moveable retaining tab.

3. The tote of claim 1, wherein the caddy further comprises a second, third and fourth guide wall.

4. The tote of claim 1, further comprising a second handle stop connected to a lower portion of the handle of the caddy.

5. The tote of claim 1, further comprising a draining standoff.

6. The tote of claim 1, further comprising slots placed along an outer vertical wall of the caddy.

7. The tote of claim 1, further comprising drainage holes placed along a bottom surface of the caddy.

8. The tote of claim 1, further comprising four draining standoffs wherein each draining standoff has a drainage hole there through.

9. The tote of claim 1, further comprising a radius corner at an outward corner of a guide wall.

10. The tote of claim 1, further comprising a second handle guide connected to a lower portion of the handle of the removable mini caddy.

11. The tote of claim 1, wherein the removable mini caddy further comprises a second, third, and fourth guide wall retainer.

12. The tote of claim 1, wherein the removable mini caddy further comprises a second corner stop located at a corner of the removable mini caddy.

13. The tote of claim 1, wherein the removable mini caddy further comprises ridges along the generally convex underside of the handle of the removable mini caddy.

14. The tote of claim 1, wherein the removable mini caddy further comprises drain holes placed along a bottom surface of the removable mini caddy.

15. A caddy comprising:

a handle with a concave upper surface, a first compartment having a semi-circular portion and a second compartment having a semi-circular portion, the two semi-circular portions being joined with a linear portion to make up an oval shaped rim, a non-moveable retaining tab extending outward from the oval shaped rim in a generally horizontal plane and then having an upward turn, a first guide wall, and a handle stop connected to a lower portion of the handle.

16. The caddy of claim 15, further comprising a second, third and fourth guide wall.

17. The caddy of claim 15, further comprising a second retaining tab.

18. A removable mini caddy comprising:

a handle having a generally convex underside for receiving the concave upper surface of the handle of the caddy of claim 15 in a nested configuration, a handle guide connected to a lower portion of the handle and continuing with the convex underside of the handle, at least one compartment, a first guide wall retainer located along an outer periphery of the removable mini caddy, and a corner stop located at a corner of the removable mini caddy.

19. The removable mini caddy of claim 18, further comprising a second, third, and fourth guide wall retainer.

20. The removable mini caddy of claim 18, further comprising a second handle guide connected to a lower portion of the handle.

21. The removable mini caddy of claim 18, further comprising a second corner stop located at a corner of the removable mini caddy.

* * * * *